US006802634B1

(12) United States Patent
Pan

(10) Patent No.: US 6,802,634 B1
(45) Date of Patent: Oct. 12, 2004

(54) WAVE CONFIGURATION OF A PIPE-TYPE LAMP

(76) Inventor: Wun Fang Pan, No. 123, Lane 99, Pu Din Road, Hsinchu City (TW)

( * ) Notice: Subject to any disclaimer, the term of this patent is extended or adjusted under 35 U.S.C. 154(b) by 0 days.

(21) Appl. No.: 10/437,025

(22) Filed: May 14, 2003

(51) Int. Cl.[7] ..... F21S 4/00

(52) U.S. Cl. ..... 362/551; 362/219; 362/241; 362/806

(58) Field of Search ..... 362/235, 249, 362/551, 555, 806, 244, 246, 311, 331, 332, 247, 245, 219

(56) References Cited

U.S. PATENT DOCUMENTS 6,033,092 A * 3/2000 Simon ..... 362/298
6,565,251 B2 * 5/2003 Chen ..... 362/236
6,612,729 B1 * 9/2003 Hoffman ..... 362/551

* cited by examiner

*Primary Examiner*—Thomas M. Sember
(74) *Attorney, Agent, or Firm*—Rosenberg, Klein & Lee

(57) ABSTRACT

The present invention relates to a pipe-type lamp, which includes an outer tube and/or inner tube to have a wave configuration. The wave tube has curved convexes in axial direction and each curved convex has peak portions and valley portions in intervals. The wave configuration of the tube can effectively reflect and/or refract the light emitted from the bulbs in the lamp that obtains a perfect decoration.

3 Claims, 4 Drawing Sheets

WAVE CONFIGURATION OF A PIPE-TYPE LAMP

BACKGROUND OF THE INVENTION

The present invention refers to a pipe-type lamp, which has a special configuration on outer tube and/or inner tube to display a beautiful shining decorative purpose.

A conventional pipe-type lamp includes an outer tube and an inner tube, wherein a plurality of bulbs are received in the inner. The surface of the outer tube and the inner tube are usually smooth. The lighting decoration is dull. A known improvement is to cover colorful paper or to provide colorful tube to increase the decorative effect. But the effect is still poor and monotonous.

Accordingly, the present invention is to provide a special pipe-type lamp having the outer tube and/or inner tube with wave surface that can reflect the light to display a beautiful outlook.

BRIEF DESCRIPTION OF THE DRAWINGS

The following drawings indicate the character and improvement of the pipe-type lamp of the present invention.

DETAILED DESCRIPTION OF THE INVENTION

Figure 2:
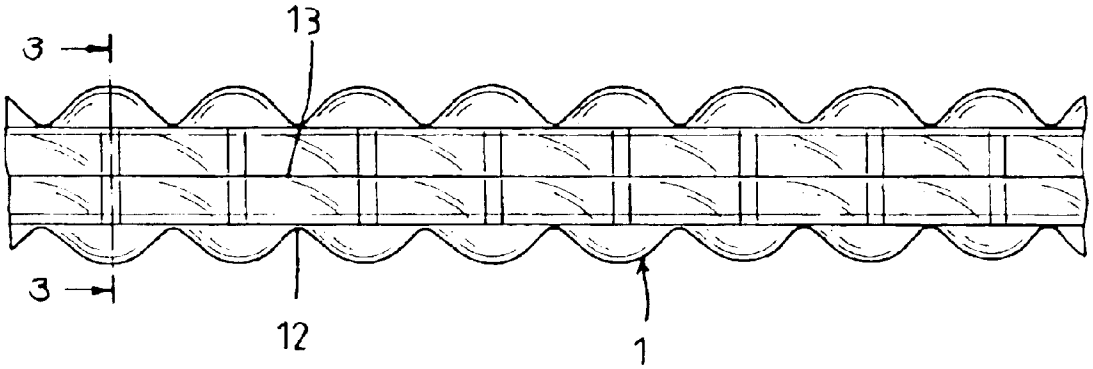
FIG. 2 shows a top plan view of the lamp shown in FIG. 1.
Figure 1:
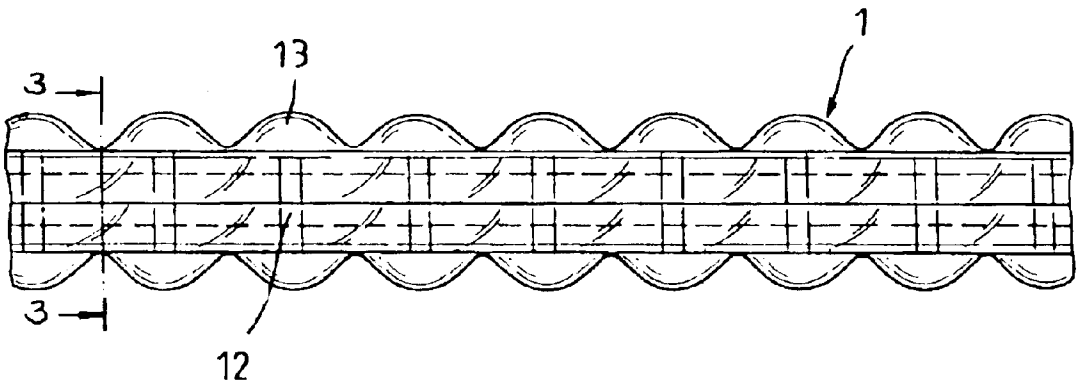
FIG. 1 shows a front plan view of a pipe-type lamp according to the present invention.
Figure 3:
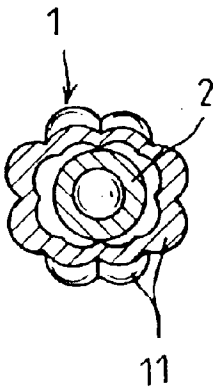
FIG. 3 is a cross-sectional plan view along line 3—3 of FIG. 1.
Figure 5:
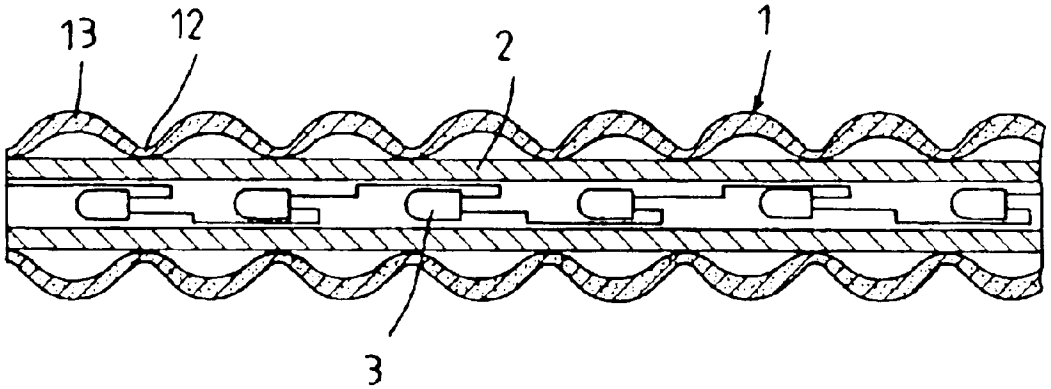
FIG. 5 is a cross-sectional plan view along line 5—5 of FIG. 4.
Figure 4:
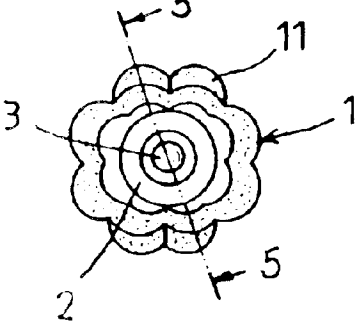
FIG. 4 shows a side plan view of the lamp shown in FIG. 1.

Referring firstly to FIGS. 1 and 3, the present invention relates to an improvement of a pipe-type lamp, which includes an outer tube (1), an inner tube (2), and several bulbs (3) received in the inner tube (2). The characteristic of the present invention is to provide the outer tube (1) having a wave configuration instead of smooth tube. In this example, the outer tube (1) is divided into eight curved convexes (11) firstly at axial direction. Each curved convex (11) is formed a wave structure having peak portions (13) and valley portions (12) in intervals. In two nearby curved convexes (11), a peak portion (13) of the first curved convex is related to a valley portion (12) of the second convex. As shown in FIGS. 4 and 5, the outer tube (1) of the pipe-type lamp has its surface with multi-angle for reflecting or refracting the light of the bulb (3). That obtains colorful and marvelous effect and increases perfect decorative utility.

Figure 7:
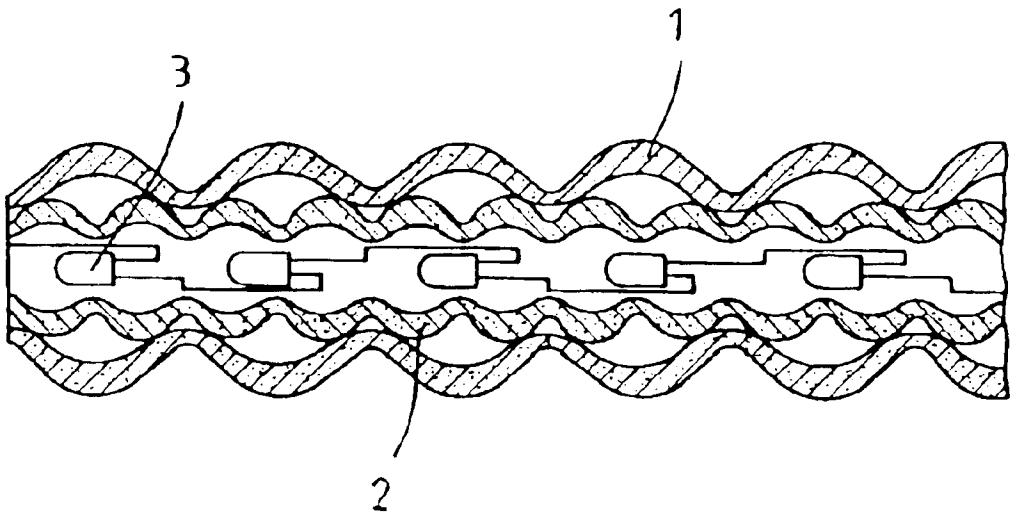
FIG. 7 is a cross-sectional plan view along line 7—7 of FIG. 6.
Figure 6:
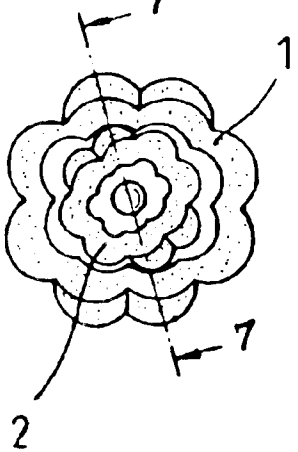
FIG. 6 shows a side plan view of a modified embodiment of a pipe-type lamp according to the present invention.
Figure 9:
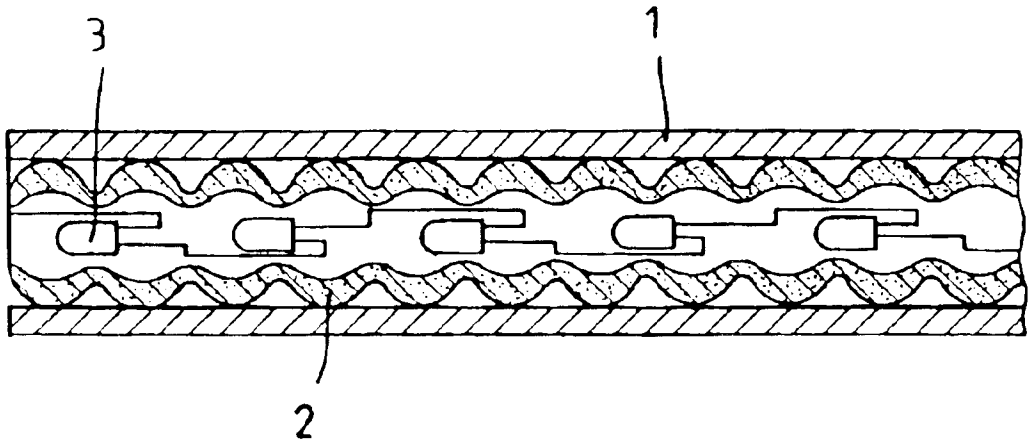
FIG. 9 is a cross-sectional plan view along line 9—9 of FIG. 8.
Figure 8:
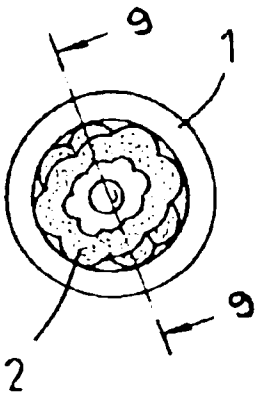
FIG. 8 shows a side plan view of another modified embodiment of a pipe-type lamp according to the present invention.

Under the same spirit of the present invention, the inner tube (2) can be designed to have a similar wave configuration to the outer tube (1), as shown in FIGS. 6 and 7. Or, in another modified embodiment as shown in FIGS. 8 and 9, the outer tube (1) has a smooth surface while only the inner tube (2) has wave configuration. Both modified embodiments can obtain a similar decorative effect to the first embodiment and will also be claimed in this application.

Accordingly, the present invention obtains utility for use and should be allowed for patent.

What is claimed is:

1. A wave configuration of a pipe-type lamp comprising an outer tube, an inner tube, and a plurality of bulbs received in the inner tube;

at least one of the outer and inner tubes having a wave configuration, wherein the at least one tube is divided into a plurality of curved convexes extending along an axial direction, each curved convex being formed with a wave structure having peak and valley portions in intervals, at least first and second adjacent ones of the curved convexes being angularly offset one from the other, with a peak portion of the first curved convex corresponding in axial position to a valley portion of the second convex, and the at least one tube lamp defining a multi-angled surface for reflecting or refracting the light of the bulb.

2. A wave configuration of a pipe-type lamp comprising:

an outer tube, an inner tube, and a plurality of bulbs received in the inner tube; the outer tube having a wave configuration, wherein the outer tube is divided into a plurality of curved convexes extending along an axial direction, each curved convex being formed with a wave structure having peak and valley portions in intervals, in adjacent curved convexes, a peak portion of the first curved convex being related to a valley portion of the second convex, and the outer tube lamp has a multi-angled surface for reflecting or refracting the light of the bulb;

wherein the inner tube has a similar wave configuration to the outer tube.

3. The wave configuration of a pipe-type lamp as claimed in claim 1, wherein the inner tube has a wave configuration having curved convexes with peak portions and valley portions, while the outer tube has a smooth surface.

* * * * *